US005902973A

United States Patent [19]

Ramey et al.

[11] Patent Number: 5,902,973

[45] Date of Patent: May 11, 1999

[54] CIRCUIT BREAKER HANDLE OPERATOR APPARATUS AND SYSTEM

[75] Inventors: Milton E. Ramey, Fayetteville; Russell B. Green, Douglasville, both of Ga.

[73] Assignee: Siemens Energy & Automation, Inc., Alpharetta, Ga.

[21] Appl. No.: 08/678,617

[22] Filed: Jul. 10, 1996

[51] Int. Cl.[6] ..... H01H 9/20; H01H 3/20

[52] U.S. Cl. ..... 200/50.01; 200/50.12; 200/330

[58] Field of Search ..... 200/50.01–50.4, 200/293, 318–326, 329–337, 43.01–43.22

[56] References Cited

U.S. PATENT DOCUMENTS

| | | | |
|---|---|---|---|
| 2,216,298 | 10/1940 | Rowe | 200/50.18 |
| 2,344,636 | 3/1944 | Quast | 200/50.18 |
| 2,741,684 | 4/1956 | Brumfield | 200/337 |
| 2,907,840 | 10/1959 | Cole | 200/50.18 |
| 2,988,612 | 6/1961 | Hercules | 200/50.18 |
| 3,009,029 | 11/1961 | Bodenschatz et al. | 200/50.15 |
| 3,171,908 | 3/1965 | Malota | 200/50.18 |
| 3,192,334 | 6/1965 | Dimond et al. | 200/50.12 |
| 3,324,259 | 6/1967 | Chamberlin et al. | 200/50.15 |
| 3,697,714 | 10/1972 | Gryctoko et al. | 200/330 |
| 3,752,947 | 8/1973 | Strobel | 200/332 |
| 3,800,114 | 3/1974 | Strobel | 200/330 |
| 3,911,235 | 10/1975 | Venzke et al. | 200/50.12 |
| 3,970,808 | 7/1976 | Gryctko et al. | 200/50.15 |
| 4,211,906 | 7/1980 | Habedank et al. | 200/330 |
| 4,612,424 | 9/1986 | Clark et al. | 200/50.18 |
| 4,835,350 | 5/1989 | Ozu et al. | 200/50.12 |
| 5,219,070 | 6/1993 | Grunert et al. | 200/330 |
| 5,288,958 | 2/1994 | Grunert et al. | 200/331 |
| 5,302,925 | 4/1994 | Castonguay et al. | 335/17 |
| 5,483,083 | 1/1996 | Olivier | 200/50.02 X |
| 5,493,083 | 2/1996 | Olivier | 200/17 R |
| 5,493,084 | 2/1996 | Whitaker et al. | 200/50.05 |

FOREIGN PATENT DOCUMENTS

| | | |
|---|---|---|
| 0612090 | 8/1994 | France . |
| 92 03 532 | 7/1993 | Germany . |
| 2279810 | 1/1995 | United Kingdom . |

*Primary Examiner*—J. R. Scott

[57] ABSTRACT

A circuit breaker operator handle apparatus means and system for use with a circuit breaker assembly having a linearly movable actuator for actuating the circuit breaker assembly to at least an ON position and an OFF position. The circuit breaker operator handle apparatus, means and system includes a housing adapted for mounting on the circuit breaker assembly, a movement translation assembly adapted to be mounted on the housing, an operator handle assembly adapted to be connected to the movement translation assembly and adapted for operator handle rotatable movement. The movement translation assembly is further adapted to provide a linear movement action for linearly moving the linearly movable actuator of the circuit breaker assembly using the rotatable movement of the operator handle assembly. The movement translation assembly includes a thermoplastic cam lever for operating the circuit breaker assembly actuator. The operator handle assembly includes a pivotally mounted latch for latching the handle in off position.

29 Claims, 18 Drawing Sheets

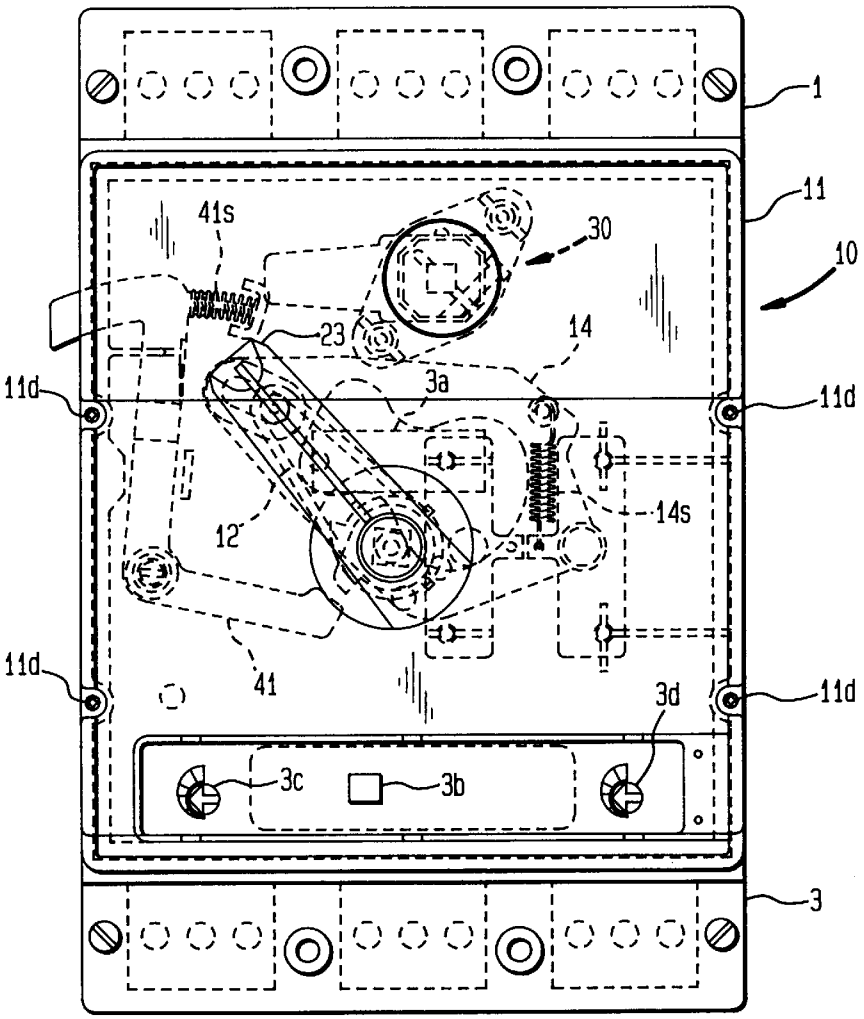
FIG. 1B
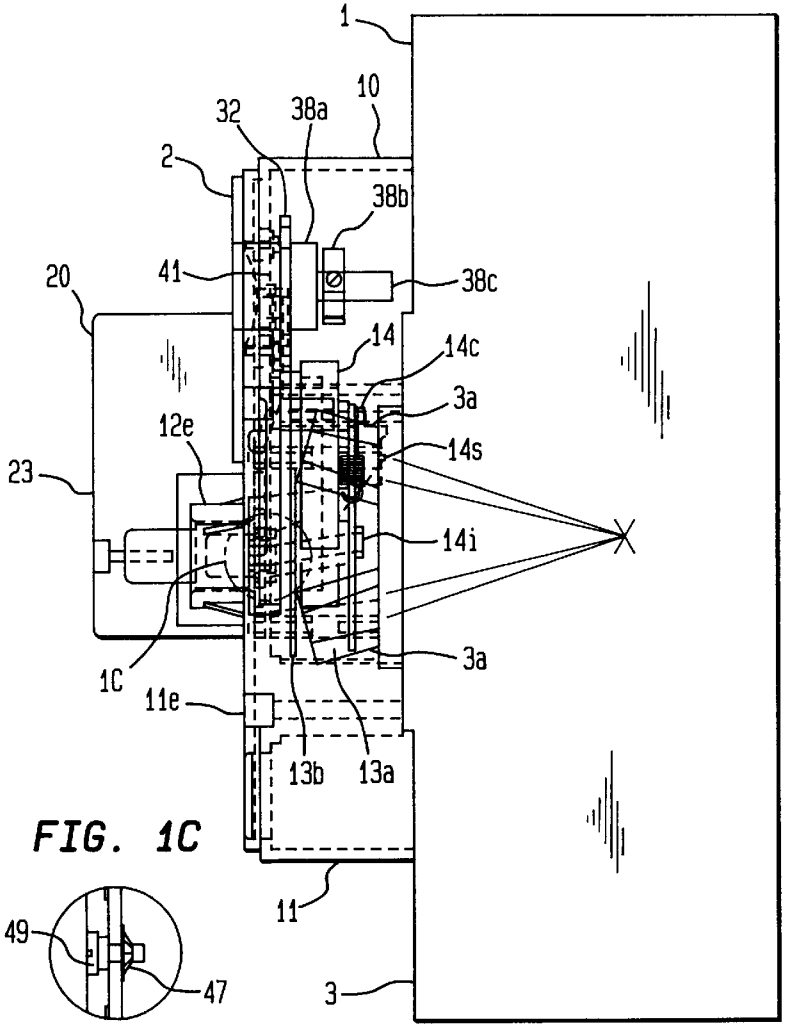
FIG. 1A
FIG. 1C

CIRCUIT BREAKER HANDLE OPERATOR APPARATUS AND SYSTEM

FIELD OF THE INVENTION

This invention relates to a circuit breaker operator handle apparatus and system that interfaces with a circuit breaker's toggle handle or other linearly movable actuator to reduce the amount of force that may be required to actuate or operate the toggle handle or other linearly movable actuator for at least certain circuit breakers.

BACKGROUND OF THE INVENTION

Certain industrial applications may require circuit breakers in which the toggle handle or other linearly movable actuator may be closed in its ON position or opened in its OFF position more easily. For example, this feature may be desirable when the circuit breakers are mounted relatively high in circuit breaker control centers so that the circuit breaker may be more difficult to reach and operate. This feature may also be desirable when the circuit breakers are installed along the horizontal plane, rather than the vertical plane, such that the toggle handles operate side to side along the horizontal plane rather than up and down along the vertical plane. There are various approaches in this area, as are shown, for example, in U.S. Pat. No. 4,211,906, assigned to Siemens AG, as well as U.S. Pat. Nos. 5,302,925; 5,219,070; 3,192,334; 5,493,084; 5,493,083; and 5,288,958. It is believed, however, that these other approaches may have certain disadvantages or other limitations. It may also be desirable to provide for features such as operator handle padlocking, enclosure door interlocking and cylinder locks.

The system of the present invention is believed to provide a better and different approach in this area. Also, the present system may be configured to provide for enclosure door interlocks and cylinder locks. Moreover, the circuit breaker operator handle of the present system allows the use of padlocks having shackle diameters ranging from three (3) to eight (8) millimeters.

SUMMARY OF THE INVENTION

It is an object of the present invention to overcome the limitations and problems of the known art.

It is another object of the present invention to provide a circuit breaker operator handle apparatus for use with a circuit breaker assembly where the circuit breaker assembly has a linearly movable actuator for actuating the circuit breaker assembly to at least an ON position and an OFF position, comprising a housing adapted for mounting on the circuit breaker assembly a movement translation assembly adapted to be mounted on the housing, an operator handle assembly adapted to be connected to the movement translation assembly and adapted for operator handle rotatable movement, the movement translation assembly being further adapted to provide a linear movement action for linearly moving the linearly movable actuator of the circuit breaker assembly using the rotatable movement of the operator handle assembly.

It is still another object of the present invention to provide the circuit breaker operator handle apparatus defined immediately above, wherein the movement translation assembly further comprises a driver assembly adapted to be connected to the operator handle assembly and adapted for driver rotatable movement using the operator handle rotatable movement, and a cam assembly adapted to be connected to the driver assembly and further adapted to translate the driver rotatable movement to provide the linear movement action.

It is yet another object of the present invention to provide a circuit breaker operator handle apparatus for use with a circuit breaker assembly, where the circuit breaker assembly has a linearly movable actuator for actuating the circuit breaker assembly to at least an ON position and an OFF position, comprising a housing means for mounting on the circuit breaker assembly, a movement translation means for mounting on the housing means, an operator handle means for connecting to the movement translation means and for being capable of operator handle rotatable movement, the movement translation means also for providing a linear movement action to linearly move the linearly movable actuator of the circuit breaker assembly using the operator handle rotatable movement of the operator handle means.

It is still another object of the present invention to provide the circuit breaker operator handle apparatus defined immediately above, wherein the movement translation means further comprises a driver means for connecting to the operator handle means and for providing driver rotatable movement using the operator handle rotatable movement of the operator handle means, and a cam means for connecting to the driver means and for translating the driver rotatable movement to provide the linear movement action.

It is still yet another object of the present invention to provide a circuit breaker operator handle system comprising a circuit breaker assembly, wherein the circuit breaker assembly has a linearly movable actuator for actuating the circuit breaker assembly to at least an ON position and an OFF position, a housing adapted to be mounted on the circuit breaker assembly, a movement translation assembly adapted to be mounted on the housing, an operator handle assembly adapted to be connected to the movement translation assembly and adapted for operator handle rotatable movement, the movement translation assembly being further adapted to provide a linear movement action for linearly moving the linearly movable actuator of the circuit breaker assembly using the rotatable movement of the operator handle assembly.

It is still another object of the present invention to provide the circuit breaker operator handle system defined immediately above, wherein the movement translation assembly further comprises a driver assembly adapted to be connected to the operator handle assembly and adapted for driver rotatable movement using the operator handle rotatable movement, and a cam assembly adapted to be connected to the driver assembly and further adapted to translate the driver rotatable movement to provide the linear movement action.

It is still yet another object of the present invention to provide a circuit breaker operator handle system comprising a circuit breaker assembly, wherein the circuit breaker assembly has a linearly movable actuator for actuating the circuit breaker assembly to at least an ON position and an OFF position, a housing means, a movement translation means for mounting on the housing means, an operator handle means for connecting to the movement translation means and for being capable of operator handle rotatable movement, the movement translation means also for providing a linear movement action to linearly move the linearly movable actuator of the circuit breaker assembly using the operator handle rotatable movement of the operator handle means.

It is still another object of the present invention to provide the circuit breaker operator handle system defined immediately above, wherein the movement translation means further comprises a driver means for connecting to the operator handle means and for providing driver rotatable movement using the operator handle rotatable movement of the operator handle means, and a cam means for connecting to the driver means and for translating the driver rotatable movement to provide the linear movement action.

These and other objects, advantages and features of the present invention will be readily understood and appreciated with reference to the detailed description of preferred embodiments discussed below together with the accompanying drawings.

BRIEF DESCRIPTION OF THE DRAWINGS

FIG. 1A is a side view similar to FIG. 1, but showing the components in non-exploded relationship and the circuit breaker operator handle assembly mounted on a front face of a circuit breaker assembly.

FIG. 1B is a front view of FIG. 1A, and FIG. 1C is an enlarged view in circle C of FIG. 1A;

DETAILED DESCRIPTION OF THE PREFERRED EMBODIMENTS

Figure 1:
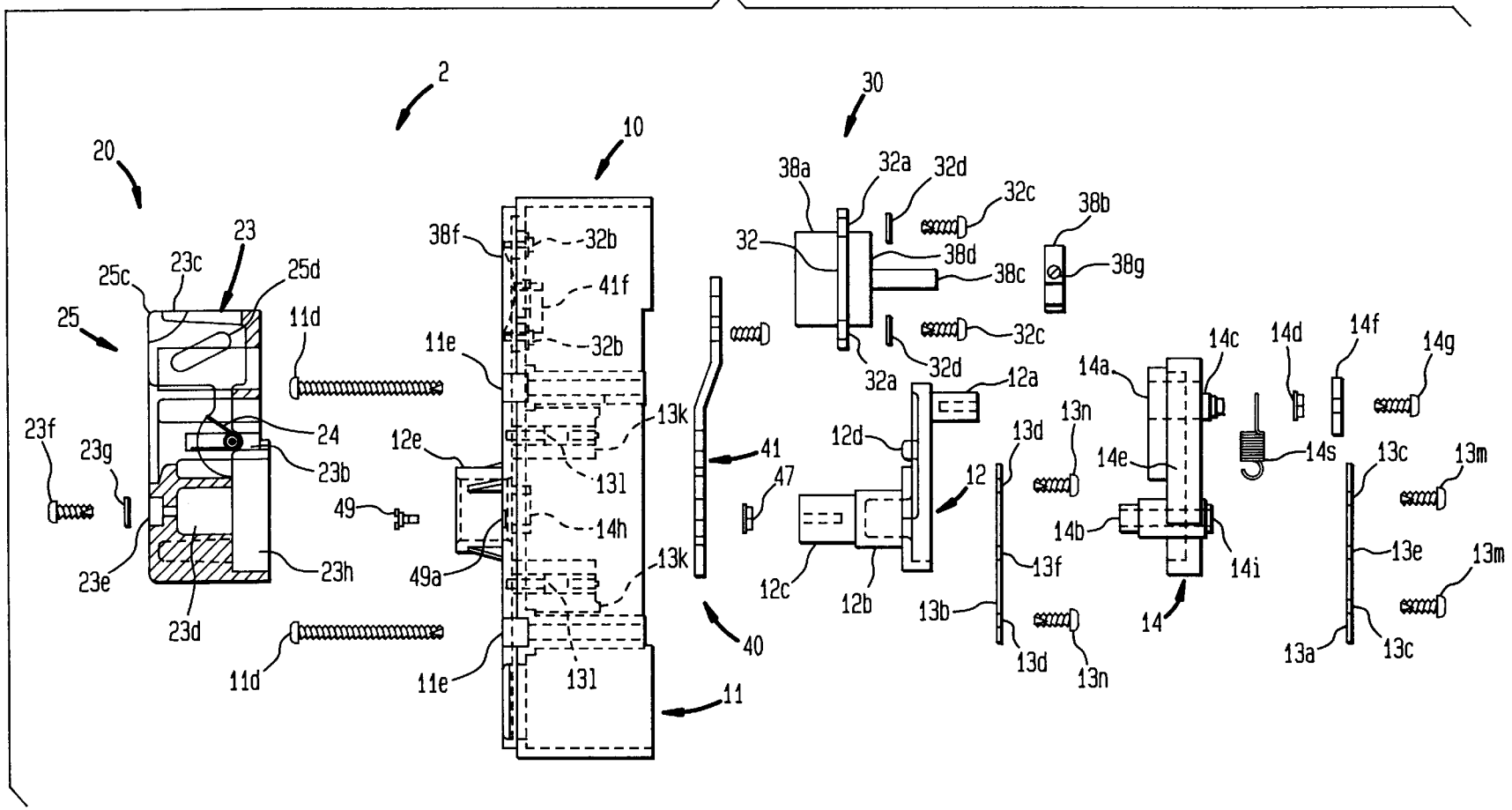
FIG. 1 is an exploded side view of the components of an embodiment of the circuit breaker operator handle assembly of the present system.
Figure 1H:
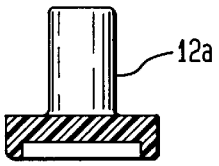
FIGS. 1G and 1H being cross section views in the direction of arrows 1G—1G and arrows 1H—1H respectively in FIG. 1D.
Figure 1G:
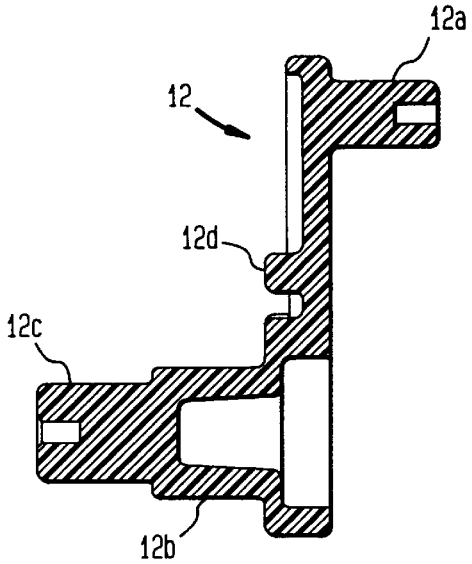
Figure 1E:
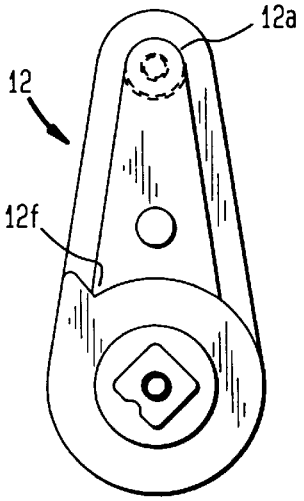
FIG. 1D, 1E, and 1F are respective side, front and rear views of the driver component of the circuit breaker operator handle assembly of the present system.
Figure 1F:
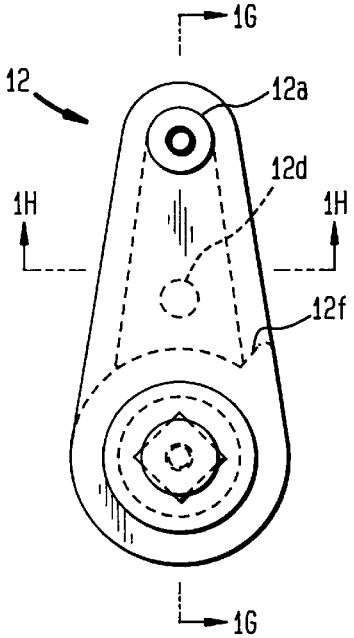
Figure 1D:
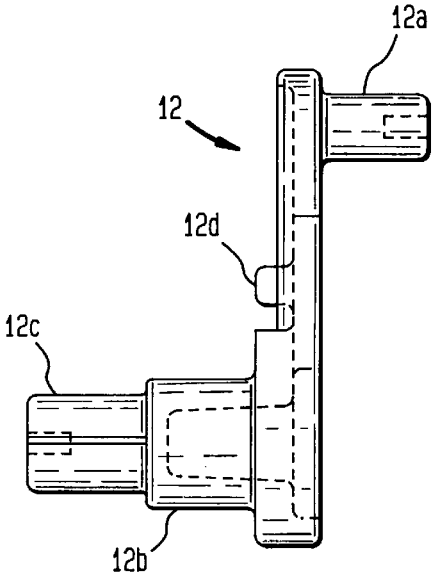

Referring to FIGS. 1 to 4 the circuit breaker operator handle system 1 comprises a circuit breaker operator handle assembly 2 and a circuit breaker assembly 3. The circuit breaker operator handle assembly 2 further comprises an operator handle housing assembly 10 and an operator handle assembly 20. The circuit breaker assembly 3 includes a circuit breaker subassembly and a trip unit subassembly, which may further include a push-to-trip button 3*b,* a trip current rating adjustment or setting (Ir) 3*c* and a magnetic current adjustment or setting (Im) 3*d* for a mag-latch (not shown) in the circuit breaker subassembly. The push-to-trip button 3*b,* the trip current rating setting 3*c* and the magnetic current setting 3*d* are all accessible through a settings window 11*a,* which may be slid out from a settings aperture or opening 11*f* of a housing 11 of the circuit breaker operator handle housing assembly 10.

The circuit breaker operator handle assembly 2 may also optionally comprise a cylinder lock assembly 30, and may also further optionally comprise an enclosure door interlock assembly 40. In particular, referring to FIGS. 1, 1A, 1B and 2 the circuit breaker operator handle assembly 2 is arranged with item 11*d,* 11*e* so that it may be easily attached, mounted or otherwise associated with the front of the circuit breaker assembly 3 by an operator. The outside dimensional contour or faceprint of the circuit breaker operator handle assembly 2 is designed so that it fits within the outside dimensional contour or faceprint of the circuit breaker assembly 3.

Figure 9C:
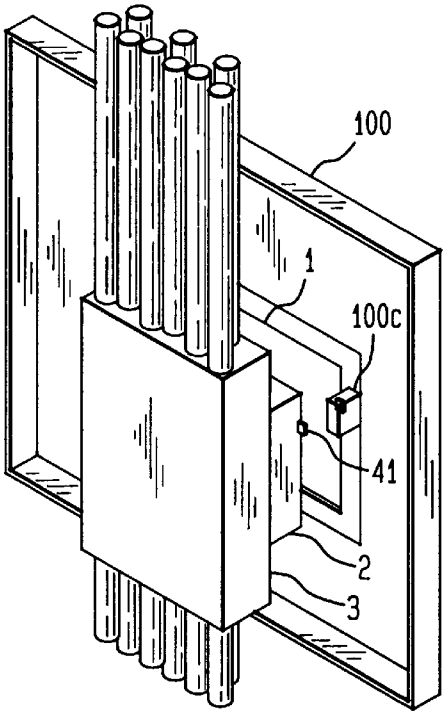
FIGS. 9A, 9B and 9C are three-dimensional perspective views of the enclosure door interlocking assembly of the circuit breaker operator handle system and enclosure door.
Figure 9B:
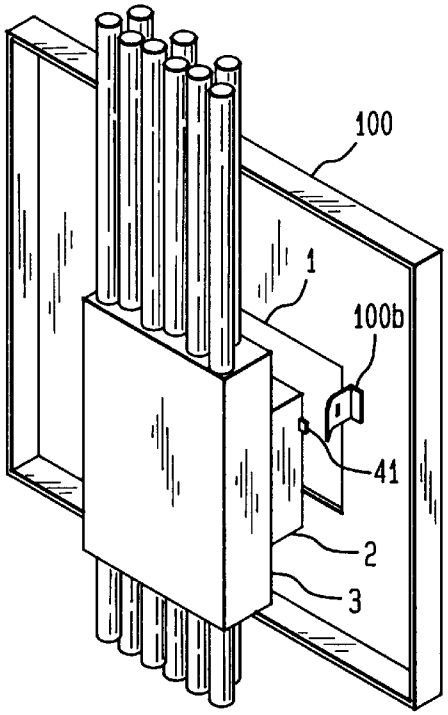
Figure 9A:
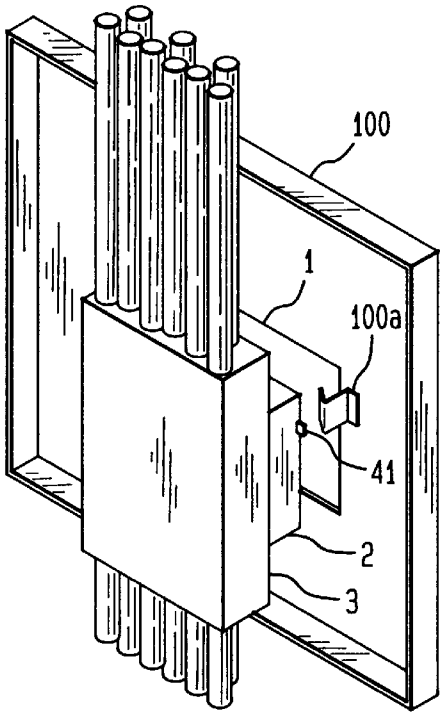

Referring to FIG. 1, FIG. 9, and FIG. 9A the circuit breaker operator handle housing assembly 10 comprises the housing 11, a driver 12, a position retainer plate assembly 13 and a cam lever 14. Together, the driver 12 and the cam lever 14 are used to provide a movement translation assembly 15. The movement translation assembly is adapted or configured to provide a linear movement action for linearly moving the linearly movable actuator or toggle handle 3*a* of the circuit breaker assembly 3 by using and translating the rotatable movement of the operator handle assembly 20. The reference S in FIG. 1A denotes the range of motion of linearly movable acuator or toggle handle 3*a*.

The housing 11 is made from molded plastic, which is preferably a thermoset plastic known as ROSITEO® 3550C that is available from Rostone Inc. Of course, the housing 11 may also be made from any other suitably appropriate material. The driver 12 is inserted through a housing driver boss 12*e* on the outside of the housing 11, such that it is seated against an inner surface of the housing 11. The driver 12 is further detailed in FIG. 1A. The position retainer plate assembly 13 comprises position retainer plates 13*a* and 13*b*. Position retainer plate 13*a* is located above position retainer plate 13*b*, and both position retainer plates 13*a* and 13*b* respectively; are located above the driver 12. Position retainer plate openings or apertures 13*c* and 13*d* in the position retainer plates 13*a* and 13*b* are aligned with four screw bosses 13*k* and 13*l* that receive four screws 13*m* and 13*n*, which are used to secure the position retainer plates 13*a* and 13*b*, respectively.

The cam lever 14 comprises a cam lever oval-shaped opening or aperture 14*a* and a cam lever pivot post 14*b* that are operably associated, respectively with a driver pivot post 12*a* of the driver 12 and a cam lever pivot post boss 14*h*, which is preferably integrally formed on the inside of housing 11 but which may be attached in any other suitably appropriate manner. A pivot post 12*c* on the driver 12 is inserted into and received by housing driver boss 12*e*, which is preferably integrally formed on the outside of the housing 11 but which may be attached in any other suitably appropriate manner. A fender washer and screw 14*f* and 14*g*, respectively, are used to fasten or secure the driver post 12*a* in the cam lever oval-shaped aperture or opening 14*a* of the cam lever 14. The position retainer plate 13*a* is also fastened to a pivot post 14*i* of cam lever 14 by inserting cam lever pivot post 14*i* in position retainer plate aperture 13*e* which is aligned over cam lever pivot post boss 14*h*. The four (4) position retainer plate apertures or openings 13*c* and 13*d* in the position retainer plates 13*a* and 13*b* are aligned with the four screw bosses 13*k* and 131 in the housing 11, respectively. Screw bosses 13*k* are longer than screw bosses 131. The retainer plate 13*a* has a retainer plate tab 13*g* having a retainer position plate tab aperture or opening 13*i*. A cam lever spring 14*s* having two hooked ends, one of which is shorter than the other, is connected by passing the hooked end of cam lever spring 14*s* through the position retainer plate tab aperture or opening 13*i* of position retainer plate 13*a*, and by connecting the longer hooked end of cam lever spring 14*s* around a cam lever pivot post 14*c* of cam lever 14. To secure the longer end of the cam lever spring 14*s* on cam lever pivot post 14*c*, a pushnut 14*d* is press-fit onto the end of the cam lever pivot post 14*c* of cam lever 14. The cam lever 14 is preferably made from a thermoplastic known as RYNITE® that is available from DuPont Corp. Of course, the cam lever 14 may also be made from any other suitably appropriate material.

Figure 3:
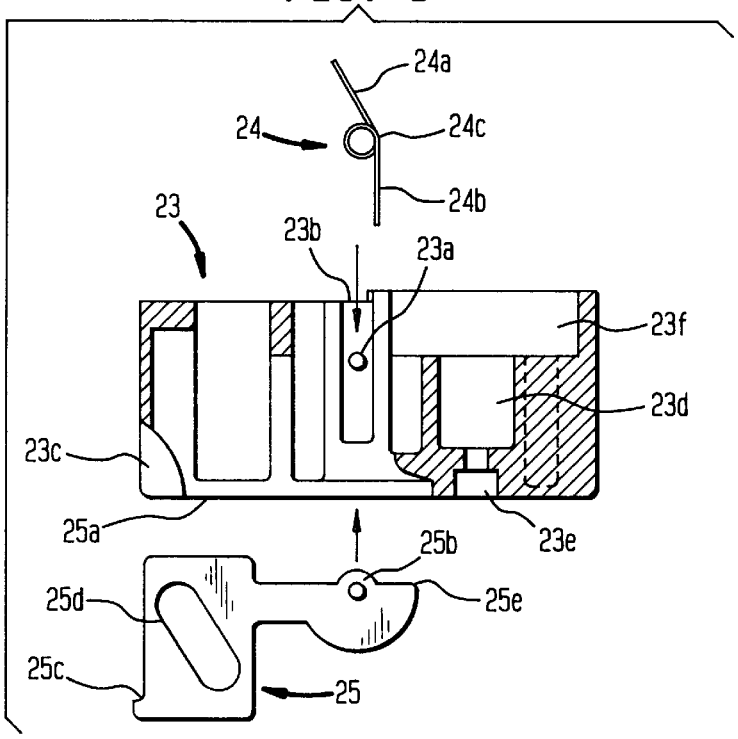
FIG. 3 is an enlarged view taken generally within rectangle 3 in FIG. 1, but rotated 90° counterclockwise, and showing an assembly relationship with another component.
Figure 3A:
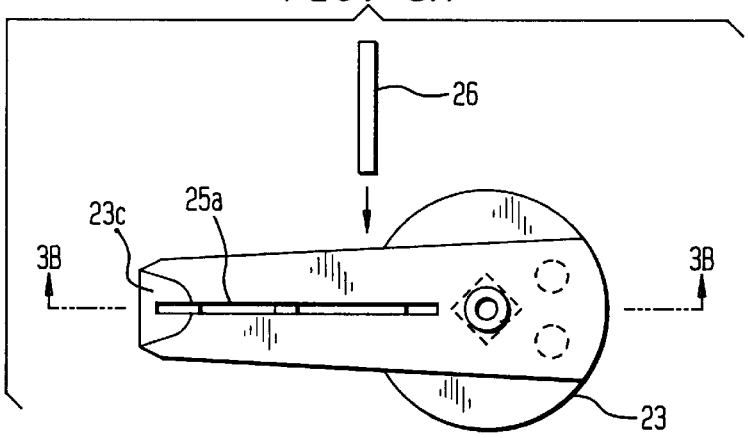
FIG. 3A is an exploded view of the circuit breaker operator handle components of the present system shown in FIG. 3.
Figure 3B:
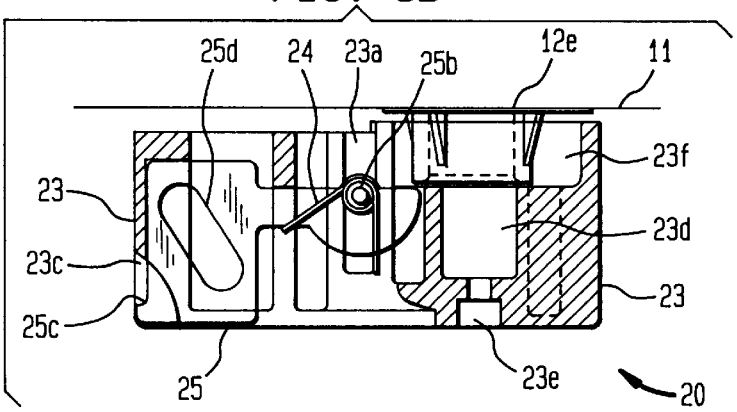
FIG. 3B is a view generally in the direction of arrows 3B—3B in FIG. 3A.

With respect to the operator handle assembly 20 and referring to FIG. 3, the operator handle assembly 20 comprises an operator handle 23, a latch return spring 24, a latch lever 25 and a spring pin 26. In particular, the operator handle 23 is adapted to receive the latch return spring 24 and the latch lever 25. The operator handle 23 includes a handle slot aperture or opening 25*a* for receiving the latch lever 25. An end 24*a* of the latch return spring 24 is depressed sufficiently into the operator handle 23 so that the latch lever 25 slips under the end 24*a* of the latch return spring 24. The spring pin 26 is press-fit through an operator handle side aperture or opening 23*a* in the side of handle 23. A coil 24*c* of the latch return spring 24 and an aperture or opening 25*b* in latch lever 25 are axially aligned with the operator handle side opening or aperture 23*a* of handle 23.

The operator handle assembly 20 is attached, fastened, mounted, secured to or otherwise associated with the driver pivot post 12*c* of the driver 12, which extends through the driver pivot post boss 12*e* of the housing 11. The operator handle 23 is attached, fastened or otherwise secured to the driver pivot post 12*c* using a screw 23*f* and lockwasher 23*g* or other suitably appropriate fastening apparatus. The screw 23*f* and lockwasher 23*g* are inserted in operator handle aperture or opening 23*e*. Also, the operator handle 23 is mounted to the housing 11 by positioning an aperture or opening 23*h* of operator handle 23 over boss 12*e* and pushing the operator handle 23 downwardly onto the boss 12*e*. Operator handle apertures 23*d* and 23*h* receive driver pivot post sections 12*c* and 12*b*, respectively.

Figure 4:
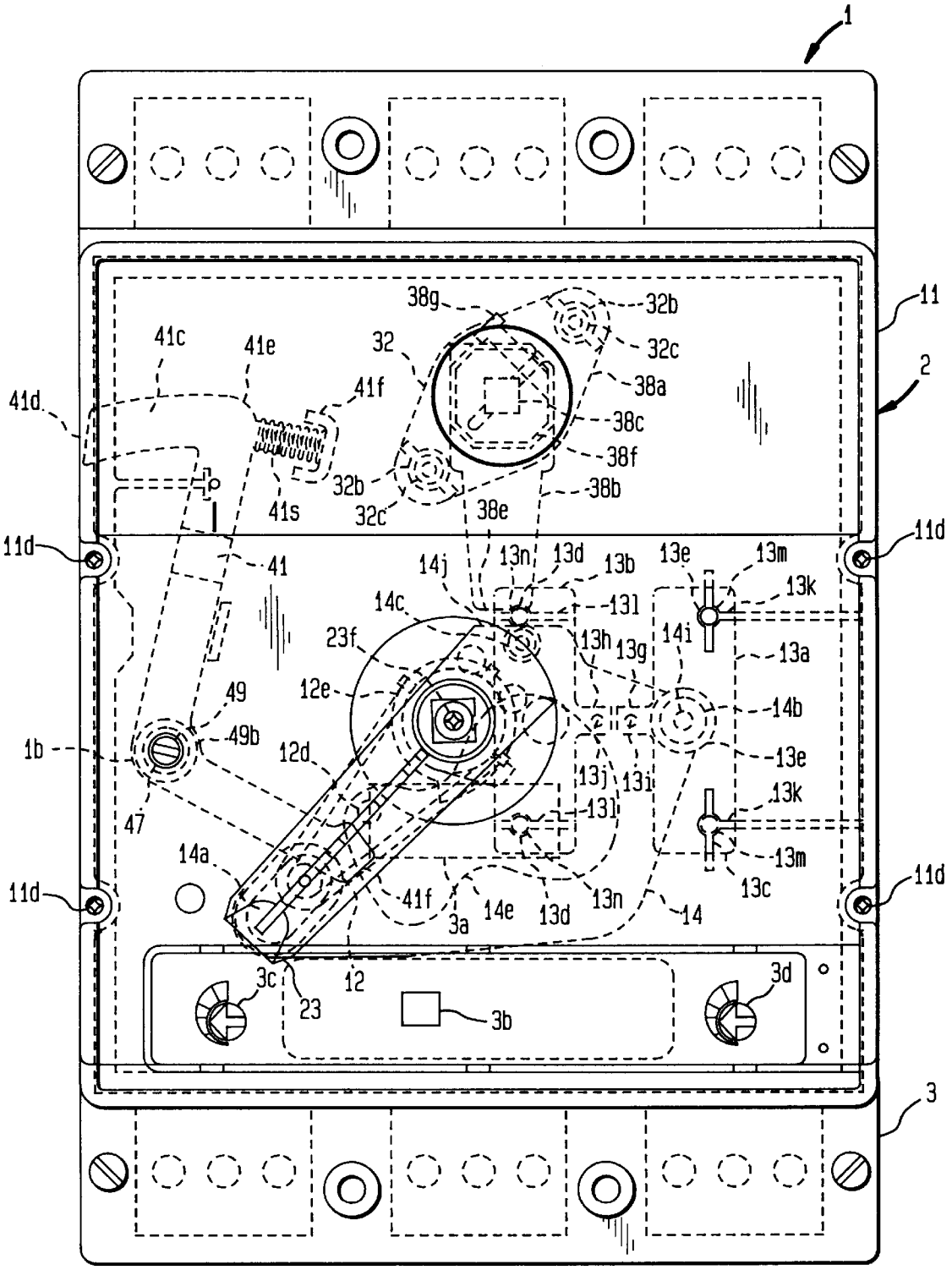
FIG. 4 is a front view of one embodiment of the circuit breaker operator handle system of the present system in the OFF position the view showing some of the internal mechanism.
Figure 4A:
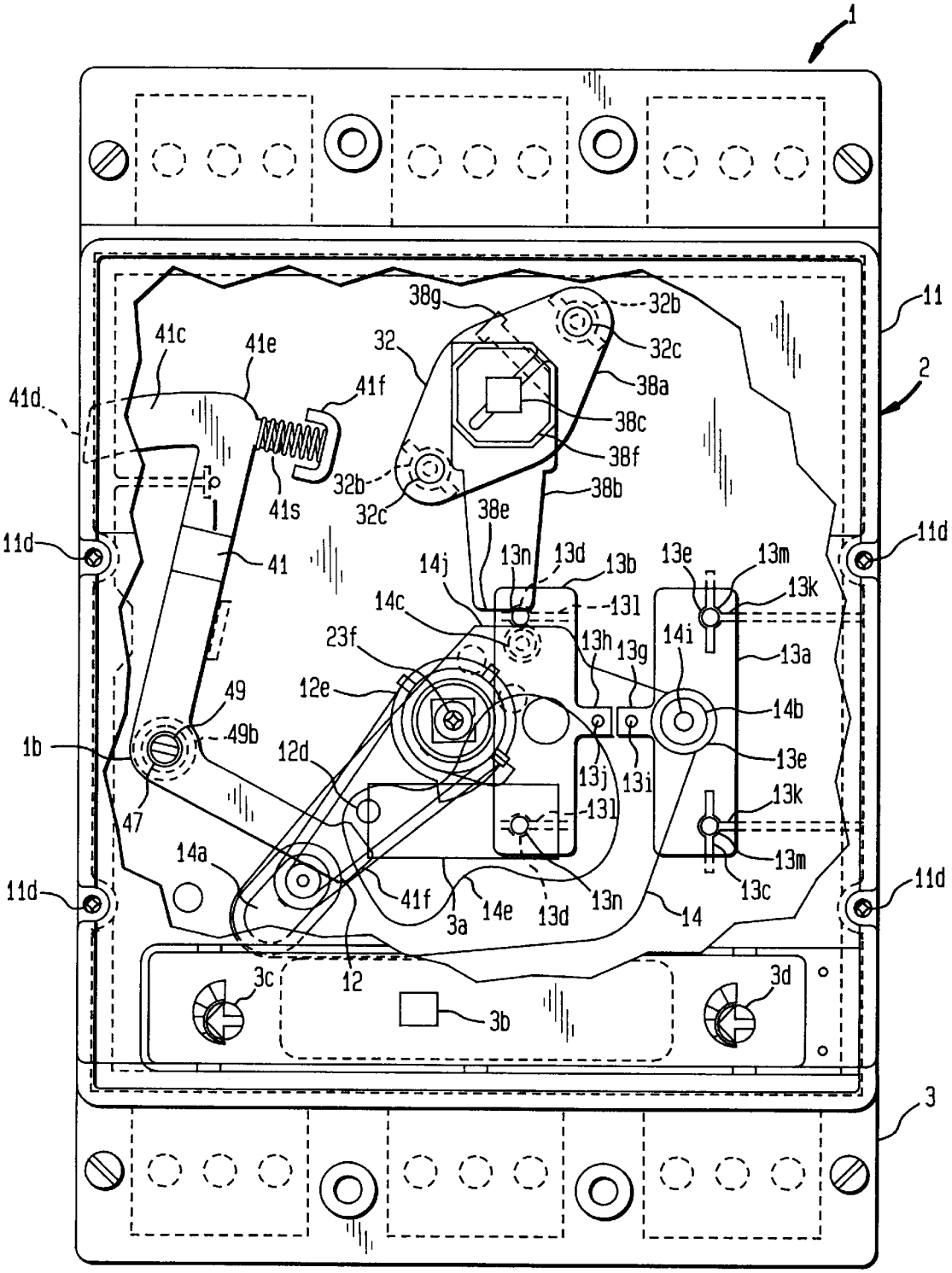
FIG. 4A is a front view corresponding to the same position represented by FIG. 4 and showing more of the internal mechanism.
Figure 5:
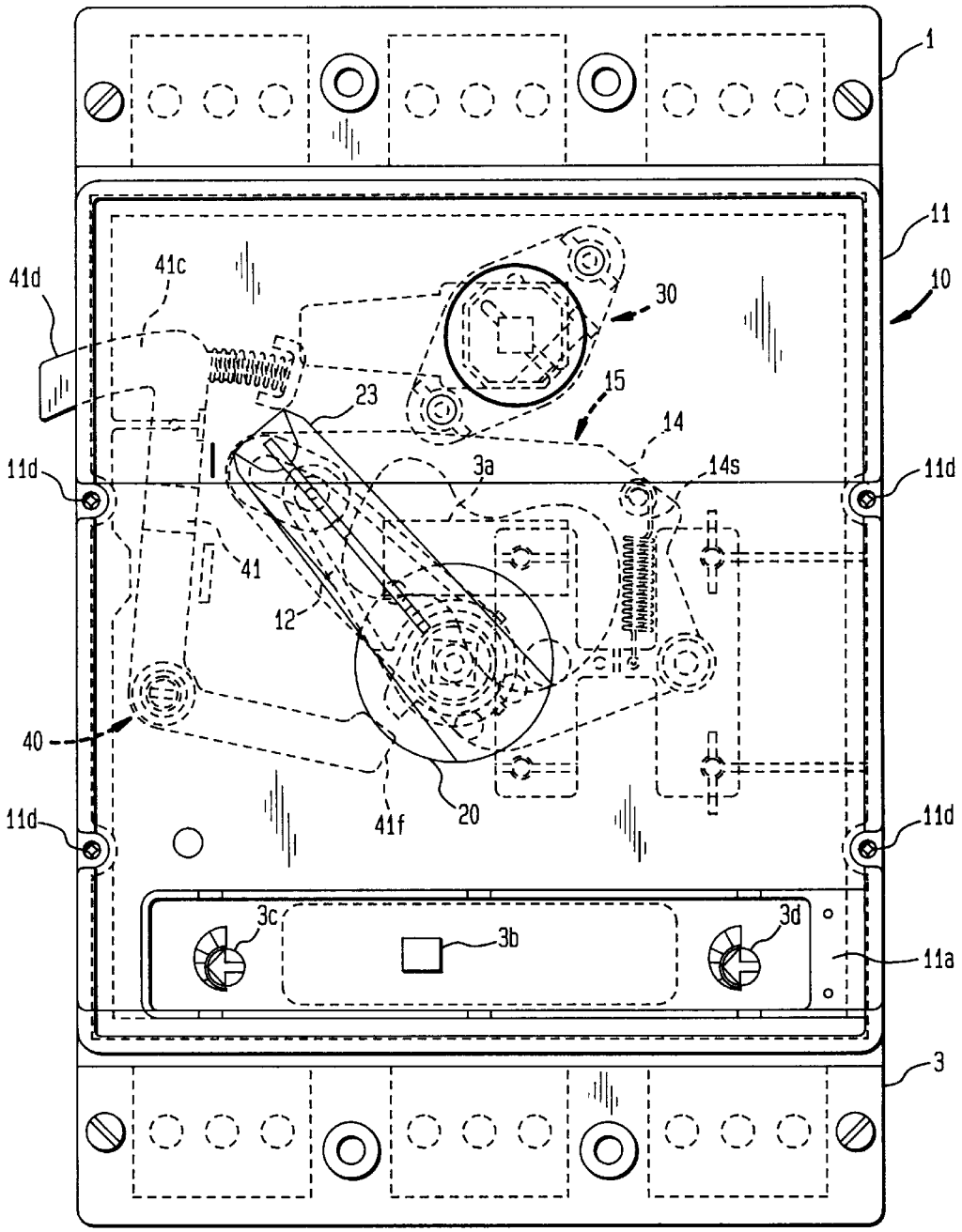
FIG. 5 is a front view of one embodiment of the circuit breaker operator handle system of the present system in the ON position the view showing some of the internal mechanism.
Figure 5A:
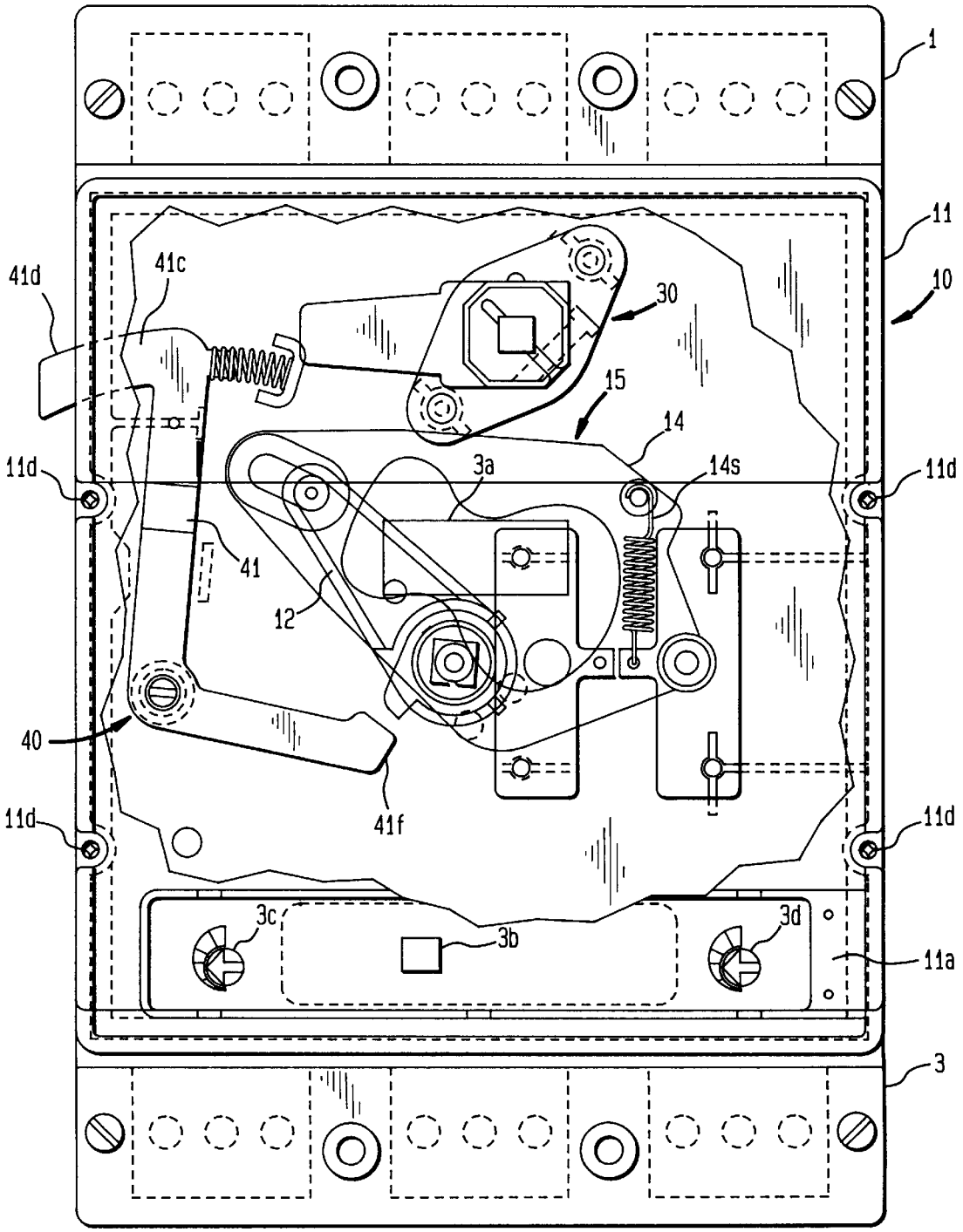
FIG. 5A is a front view corresponding to the same position represented by FIG. 5, and showing more of the internal mechanism.

Referring to FIGS. 4 and 5, the operator handle 23 moves from the OFF position to the ON position through a ninety degree (90°) turn, and always remains inside the contour, or "faceprint" of the housing 11, regardless of the position of the operator handle 23, and is designed to operate the toggle handle 3*a* of the circuit breaker assembly 3 with less effort. The operator handle 23 is made from molded plastic that is preferably a thermoplastic known as MINLON® that is available from DuPont Corp. Of course, the operator handle 23 may also be made from any other suitably appropriate material. While operator handle 23 appears in various positions in FIGS. 4, 5, 6, 7, and 8, the respective positions assumed by various positions of the internal mechanism are shown only in phantom for illustrative clarity. In all of these front views, the center line of the operator handle falls coincident with the center line of an arm of driver 12 that contains driver pivot post 12*a*. In the views of FIGS. 4A, 5A, 6A, 7A, and 8A, the operator handle and the front of the housing have been broken away to reveal, in solid lines, the respective positions assumed by various portions of the internal mechanism.

Figure 2:
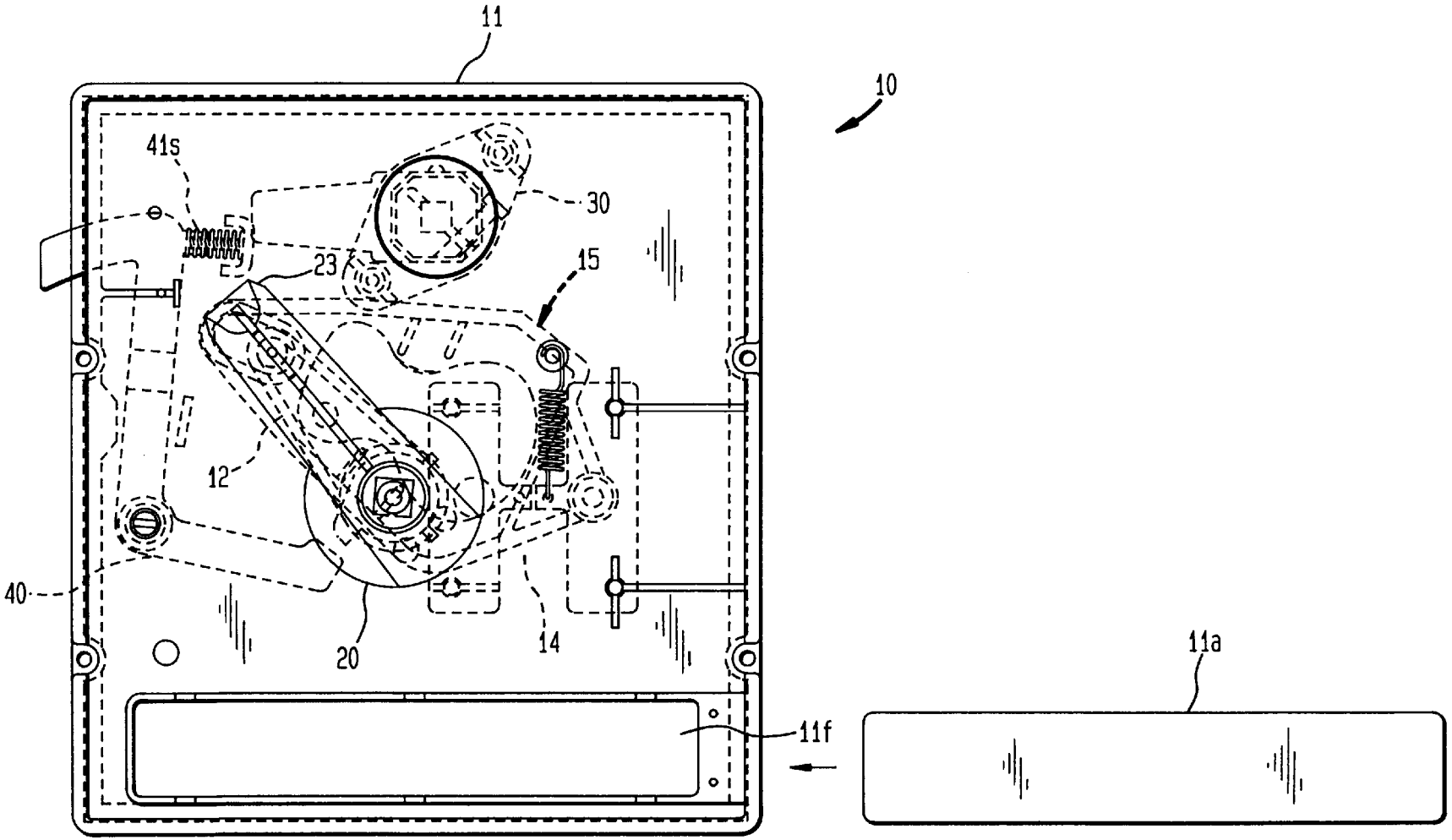
FIG. 2 is a front view of one embodiment of the circuit breaker operator handle assembly of the present system.
Figure 2A:
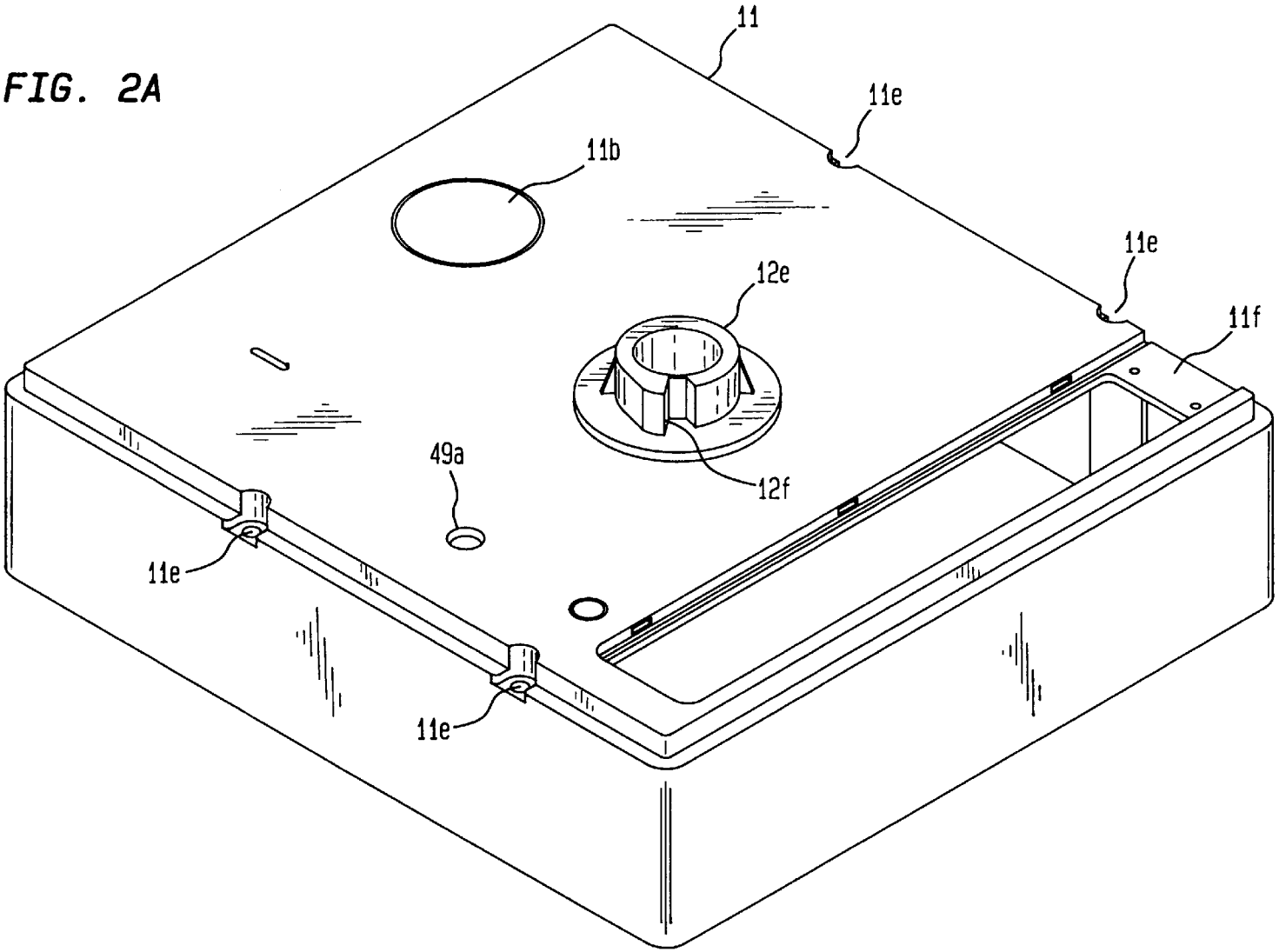
FIG. 2A is a three-dimensional perspective view of the housing of the circuit breaker operator handle assembly of the present system this view being similar to FIG. 1B, but on a slightly larger scale and showing some of the internal mechanism.
Figure 2B:
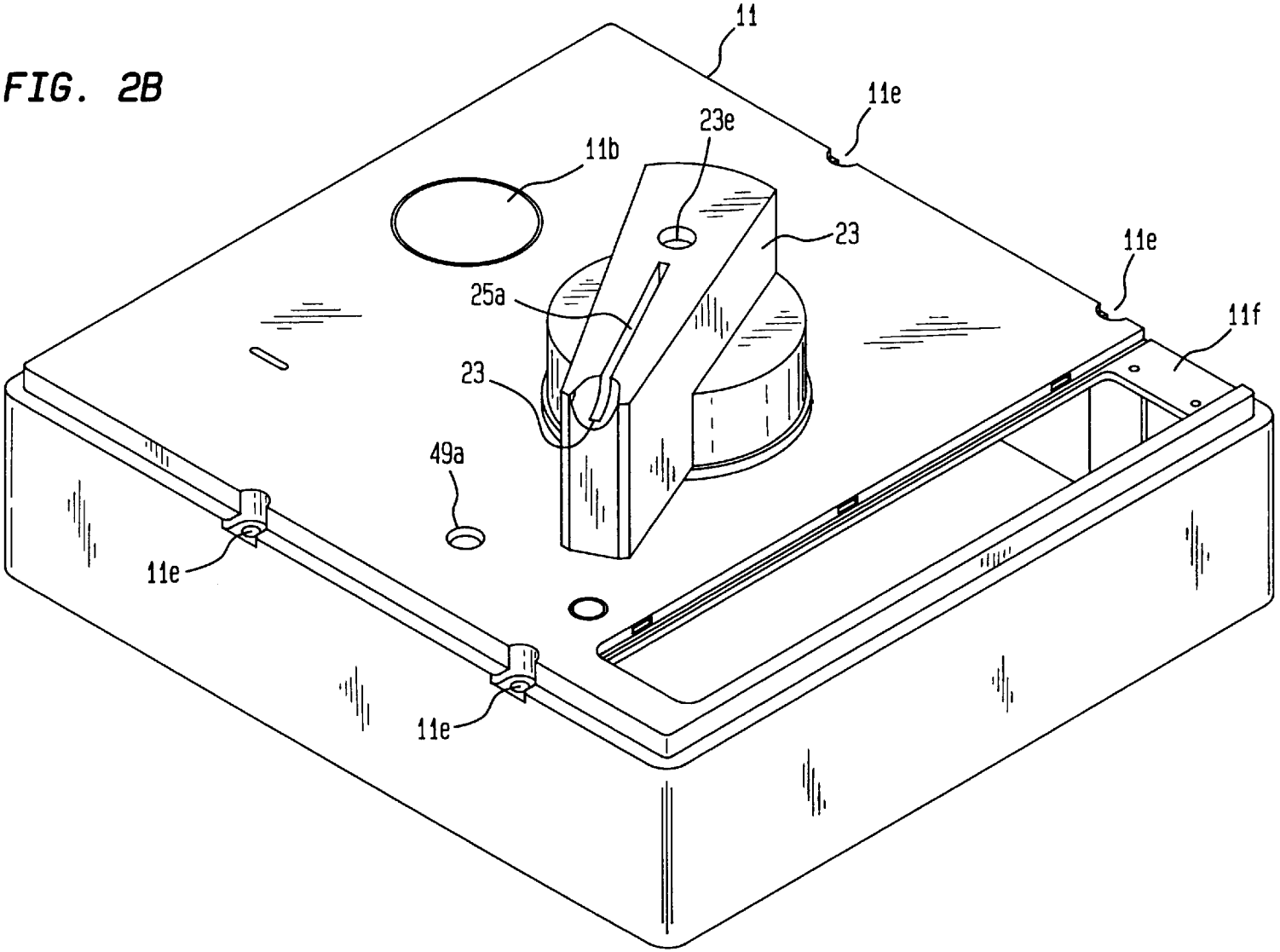
FIG. 2B is a three-dimensional perspective view of the housing and operator handle of the circuit breaker operator handle assembly of the present invention.

The operator handle 23 may be locked in the OFF position using up to three padlocks (not shown) having shackle diameters ranging from three (3) to eight (8) millimeters by connecting them through a latch lever aperture or opening 25*d* of the handle latch lever 25. In particular and referring to FIG. 3, an operator places a finger in a depression 23*c* which is integrally formed in the operator handle 23, so as to catch a lip 25*c* on the operator handle latch lever 25. In this way, the latch lever 25 may be rotated upwardly through operator handle aperture or opening 25*a* with respect to a pivot point represented by operator handle aperture or opening 23*a*. As a result, the latch lever aperture or opening 25*d* is exposed so that up to three (3) padlocks (not shown) may be inserted therein. Finally, referring to FIG. 2A, since latch lever locking end 25*e* is rotated toward the housing 11 when the latch lever 25 is lifted, it is able to engage and be received by a latch lever locking lip 12*f* in boss 12*e*. In this ways the operating handle 23 may be locked in position so that it may not be operated.

Referring to FIG. 4, the circuit breaker operator handle assembly 2 may also optionally include the cylinder lock assembly 30 to allow the circuit breaker assembly 3 to be locked in its OFF position. The cylinder lock assembly 30 comprises a cylinder lock 38*a* and a slide locking lever 38*b*. The optional cylinder lock 38*a* is inserted by removing a knock-out 11*b* (see FIG. 2A) from housing 11. The slide locking lever 38*b* is seated on a square shaped post or spigot 38*c* of cylinder lock 38*a* such that it contacts the cylinder lock surface 38*d* (see FIG. 1) of the cylinder lock 38*a*, and is then secured using cylinder lock screw 38*g*. The cylinder lock 38*a*, which is inserted through the back of housing 11, has cylinder lock apertures or openings 32*a* in a cylinder lock flange 32 of the cylinder lock 38*a* that are positionally aligned with cylinder lock screw bosses 32*b*, which are preferably integrally formed on the inside of housing 11 but which may also be attached in any other suitably appropriate manner. Cylinder lock flange screws and lockwashers 32*c* and 32*d*, or any other suitably appropriate fastening apparatus, may be used to secure the cylinder lock assembly 30 to the cylinder lock screw bosses 32*b* on the inside of the housing 11.

The cylinder lock 38*a* is adapted to be inserted through the backside of housing 11 and is secured or otherwise fastened to the backside of the housing 11 using two screws 32*c* and two washers 32*d*. The cylinder lock assembly 30 further comprises a locking lever 38*b*. By inserting a key (not shown) in octagonally-shaped slot aperture or opening 38*f*, the locking lever 38*b* may be rotated or turned ninety degrees (90°) from its locked position to its unlocked position. When the cam lever 14 is in its OFF position, the cylinder lock 38*a* and the locking lever 38*b* may be rotated or turned ninety degrees (90°) in a counter-clockwise direction from the position shown in FIG. 2 to the FIG. 4 position. This allows an end 38*e* of the locking lever 38*b* to contact a locking lever surface 14*j* the cam lever 14, thereby preventing it from rotating to its ON position.

Referring to FIGS. 1, 4, 10A, 10B and 10C, the circuit breaker operator handle assembly 2 may also optionally include an enclosure door interlock assembly 40. The door latch interlock assembly may be used to interlock an enclosure door 100 of an enclosure (not shown) that is used to enclose the circuit breaker operator handle system 1, which comprises the circuit breaker operator handle assembly 2 and the circuit breaker assembly 3. The door interlock assembly 40 comprises a door latch defeater screw 49, a door latch interlock 41 and a door latch return spring 41*s*. The door latch defeater screw 49 is inserted in a door latch defeater screw aperture or opening 49*a* of the housing 11. The door latch interlock 41 is positioned inside the housing 11 such that its door latch interlock pivot opening or aperture 49*a* is aligned with the door latch defeater screw 49. The door latch interlock 41 is also positioned such that a curved end 41*c* of the door latch interlock 41 passes through a rectangular aperture or opening 41*d* located in a side of housing 11, when interlocking the enclosure door. To secure the door latch defeater screw 49, a pushnut 47 is press-fit onto one end of the door latch defeater screw 49. Also one end of the door latch interlock return spring 41*s* fits over a tab 41*e* of door latch interlock 41, and another end of the door latch interlock return spring 41*s* is seated in a u-shaped door latch return spring receiver 41*f*, which is preferably integrally formed from and projects from the inside of housing 11 but which may also be attached in any other suitably appropriate manner.

The circuit breaker operator handle apparatus, means and system operates as follows:

As discussed, the operator handle assembly 20 is connected to the driver pivot post 12*c* of the driver 12. When the operator handle 23 is rotated ninety degrees (90°) clockwise from the OFF position to the ON position or counter-clockwise from the ON position to the OFF position, the driver 12 is similarly rotated since the driver 12 and the operator handle 23 are each aligned along the same pivot or rotational point. Driver 12 may forms a crank that has a crank arm containing driver pivot post 12*a* at its end. Also, as discussed, the driver 12 is connected to the cam lever 14 through the cam lever oval-shaped aperture or opening 14*a* on one end of the cam lever 14*e* which receives driver pivot post 12*a* of driver 12. Another end of the cam lever 14 has pivot posts 14*b* and 14*i* which are movably mounted or otherwise associated between driver pivot post boss 14*h* and position retainer plate aperture or opening 13*e* of position retainer plate 13*a*, which receives cam lever pivot post 14*i*.

When the driver 12 rotates, the pivot post 12*a* slides from one end of the cam lever oval-shaped aperture or opening 14*a* to the other end thereof so as to apply some force to the cam lever 14 such that it moves in the same rotational direction as the driver 12 and operator handle 23. Cam lever lobes 14*e*, which are in the center of the cam lever 14*e* contact the circuit breaker toggle handle 3*a* and apply a linear force to the toggle handle 3*a* or other linearly movable actuator so as to displace the circuit breaker toggle handle 3*a* from its OFF position to its ON position or from its ON position to its OFF position. Finally, the cam lever spring 14*s* is connected between the cam lever 14 and the position retainer plate 13*a* so that the cam lever 14 remains relatively tight against the circuit breaker toggle handle 3*a* so as to prevent or at least reduce any chatter that may be associated with its operation.

Referring to FIGS. 4, 5, 9A, 9B and 9C, the circuit breaker operator handle assembly 2, as discussed, may also comprise an optional door interlock assembly 40 that is used to interlock the enclosure door 100 when the circuit breaker assembly 3 is closed in its ON position. The enclosure door 100 must, of course, have some slot or other structural feature for engaging the door latch interlock 41 as is shown, for example, at 100*a*, 100*b* and 100*c* in FIGS. 10A, 10B and 10C. The door latch lever interlock 41, is attached to, fastened to, secured to or otherwise associated with the inside of housing 11 at its pivot point 41*b* using the latch defeater screw 49 and the pushnut 47. The tab 41*e* of the door latch lever 41 is inserted in the door latch interlock return spring 41*s*. The door latch interlock return spring 41*s* exerts a biasing force that pushes the curved end 41*c* of the latch lever 41 through the rectangular slot aperture or opening 41*d* in the side of housing 11. As a result, and referring to FIG. 4, another end 41*f* of the door latch 41 pushes against the post 12*d* on the driver 12. As the driver 12 rotates from the ON position to the OFF position, the curved end 41*c* of the door latch 41 retracts In this way, the enclosure door 100 may only be opened when the operator handle 23 and the toggle handle 3*a* of the circuit breaker assembly 3 are in their OFF positions. Accordingly, when the enclosure door is open and the operator handle 23 and toggle handle 3*a* of the circuit breaker assembly 3 are in their OFF position, the enclosure door interlock assembly 40 prevents the operator handle 23 from being rotated or turned to its ON position.

Figure 6:
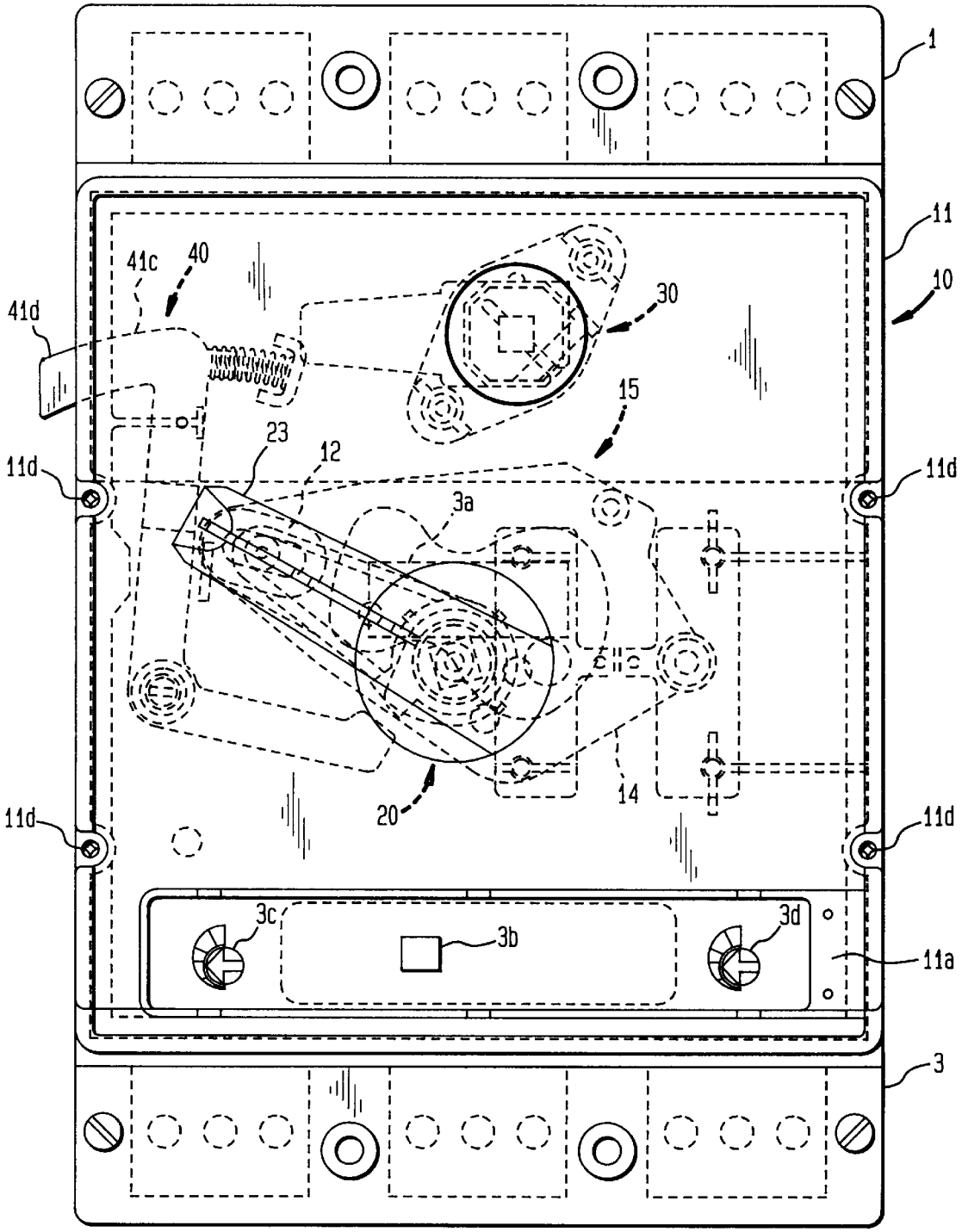
FIG. 6 is a front view of one embodiment of the circuit breaker operator handle system of the present system in the TRIPPED position the view showing some of the internal mechanism.
Figure 6A:
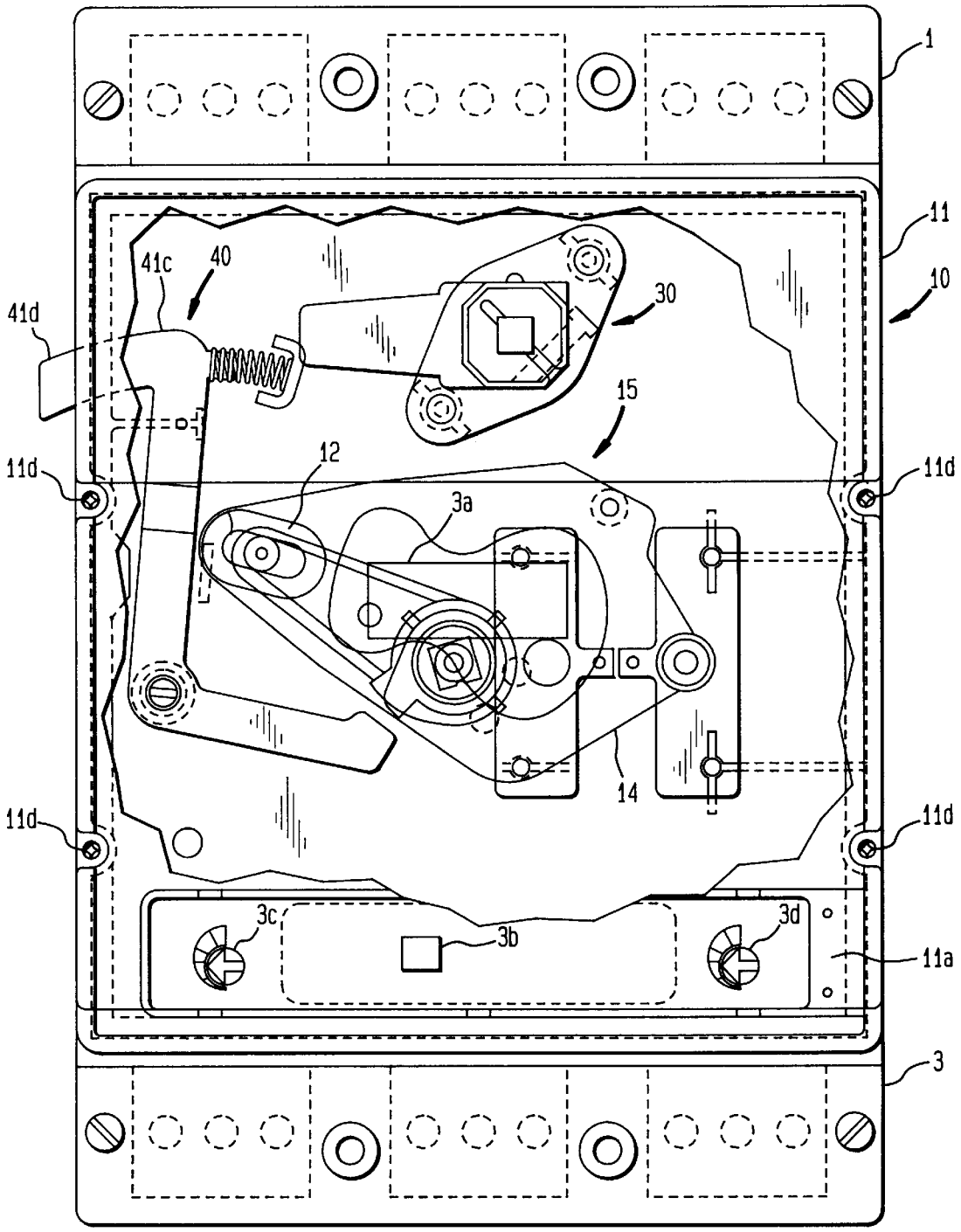
FIG. 6A is a front view corresponding to the same position represented by FIG. 6, and showing more of the internal mechanism.
Figure 7:
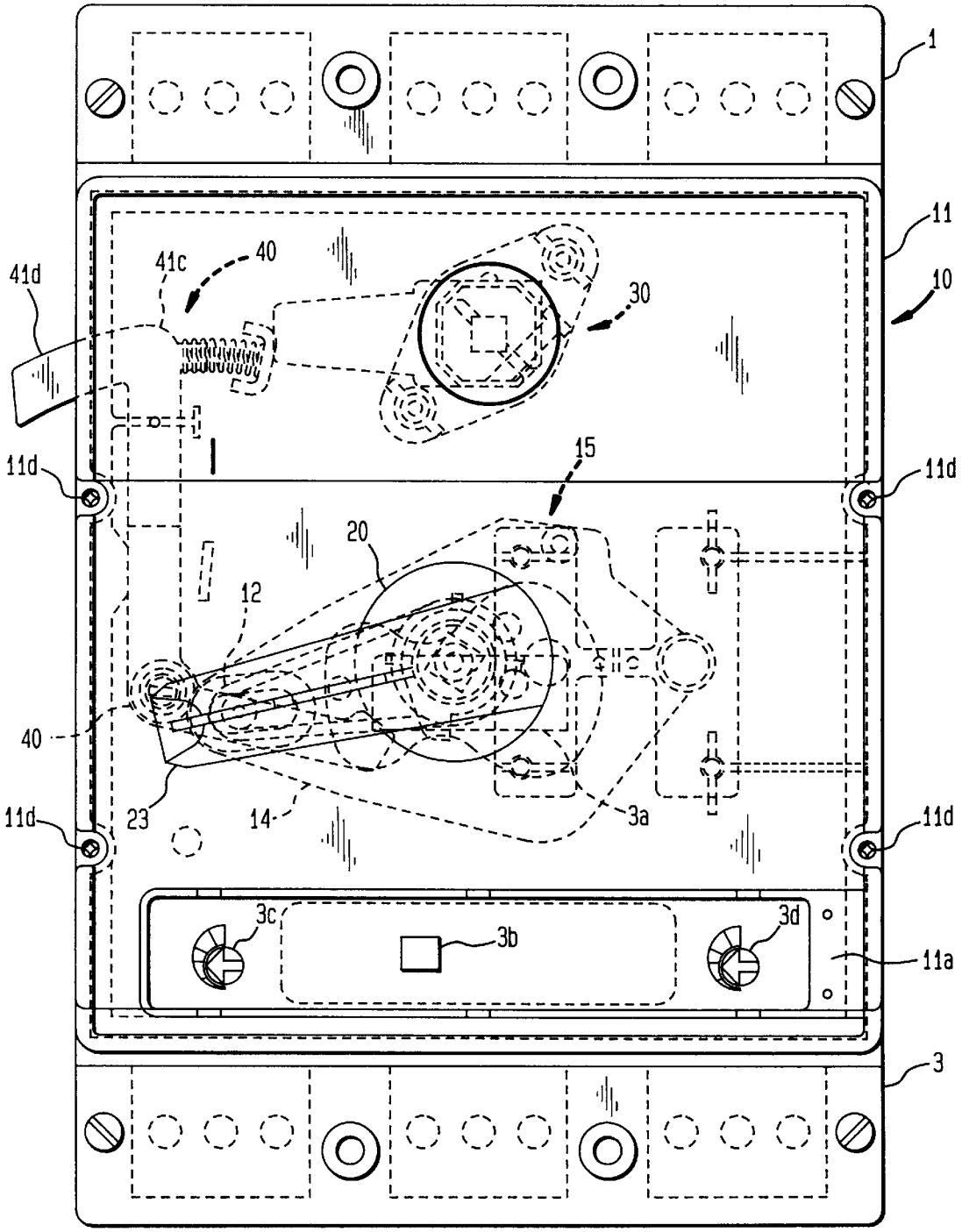
FIG. 7 is a front view of one embodiment of the circuit breaker operator handle system of the present system in the LATCHED position the view showing some of the internal mechanism.
Figure 7A:
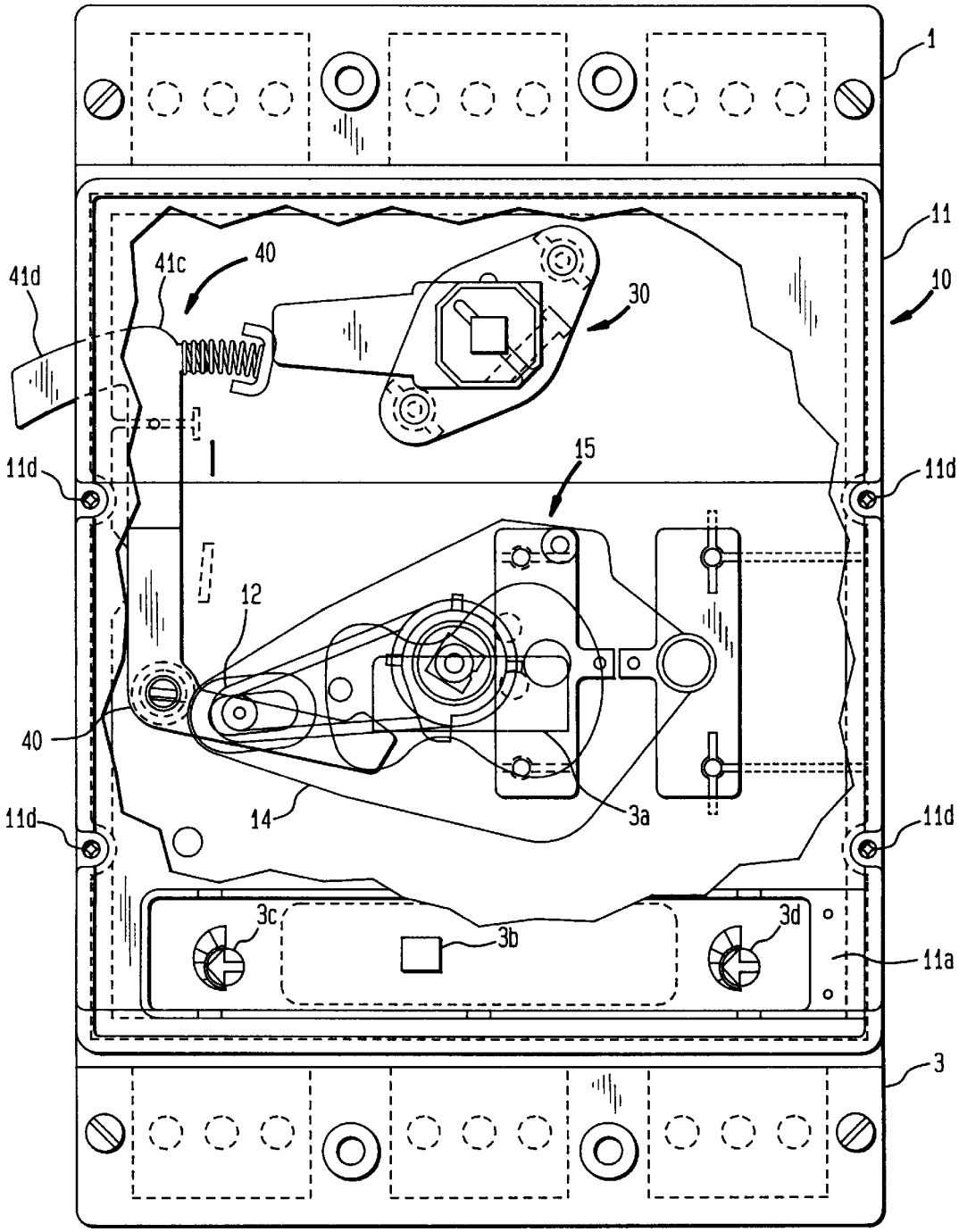
FIG. 7A is a front view corresponding to the same position represented by FIG. 7, and showing more of the internal mechanism.

Referring to FIG. 6, the TRIPPED position is located in an intermediate position between the OFF and ON positions of FIGS. 4 and 5.

Referring to FIG. 7*e* which shows the circuit breaker operator handle assembly 2 in its latched position, as the driver 12 rotates from its OFF position to its ON position, the end 41*f* of the latch lever 41 is forced or pushed against the driver post 12*d* on the driver 12 and enters a driver lip or pocket 12*h* after it slides or travels beyond the post 12*d*. The driver pocket 12*h* prevents the driver 12 from being rotated or turned to its ON position unless the door latch interlock 41 is first released. To enable operation of the circuit breaker assembly 3 when the enclosure door 100 is closed, the door latch interlock 41 may be released by inserting a hook-shaped protrusion in slot apertures or openings in the housing 11 and the enclosure door 100. The hook-shaped protrusion is positioned so that it limits the travel of the latch lever 41 to one half (½) of its normal travel distance when the operator handle 23 is rotated or turned to its ON position. When the operator handle 23 is in its ON positions the latch lever 41 extends in front of the hook-shaped protrusion so as to prevent the enclosure door 100 from opening. In certain cases, however, it may be desirable or necessary to open the enclosure door 100 without first placing the circuit breaker assembly 3 in its OFF position. In such cases and referring to FIG. 5, the door latch 41 may be defeated by turning the latch defeater screw 49 clockwise to retract the latch lever 41.

Figure 8:
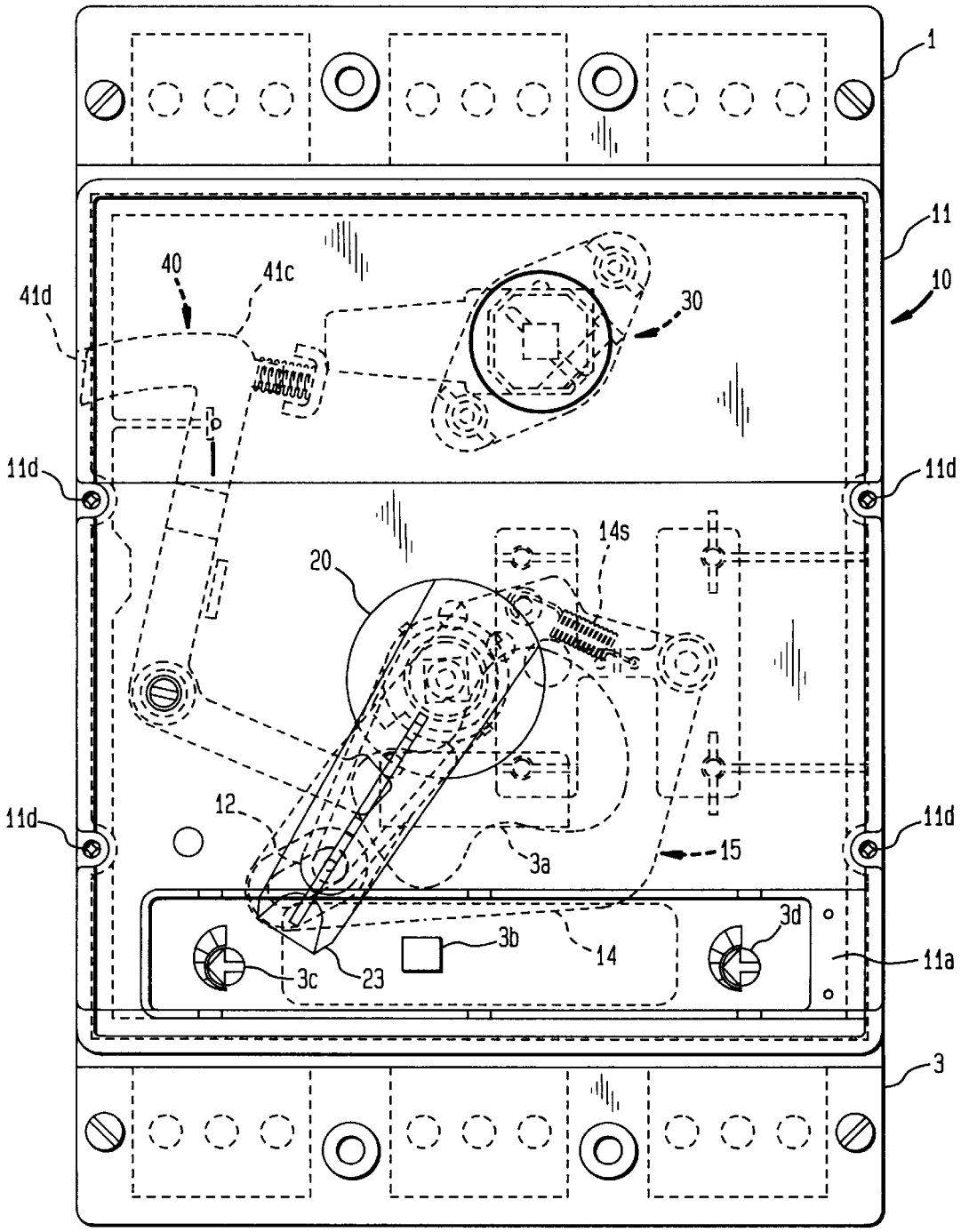
FIG. 8 is a front view of one embodiment of the circuit breaker operator handle system of the present system in the RESET position the view showing some of the internal mechanism.
Figure 8A:
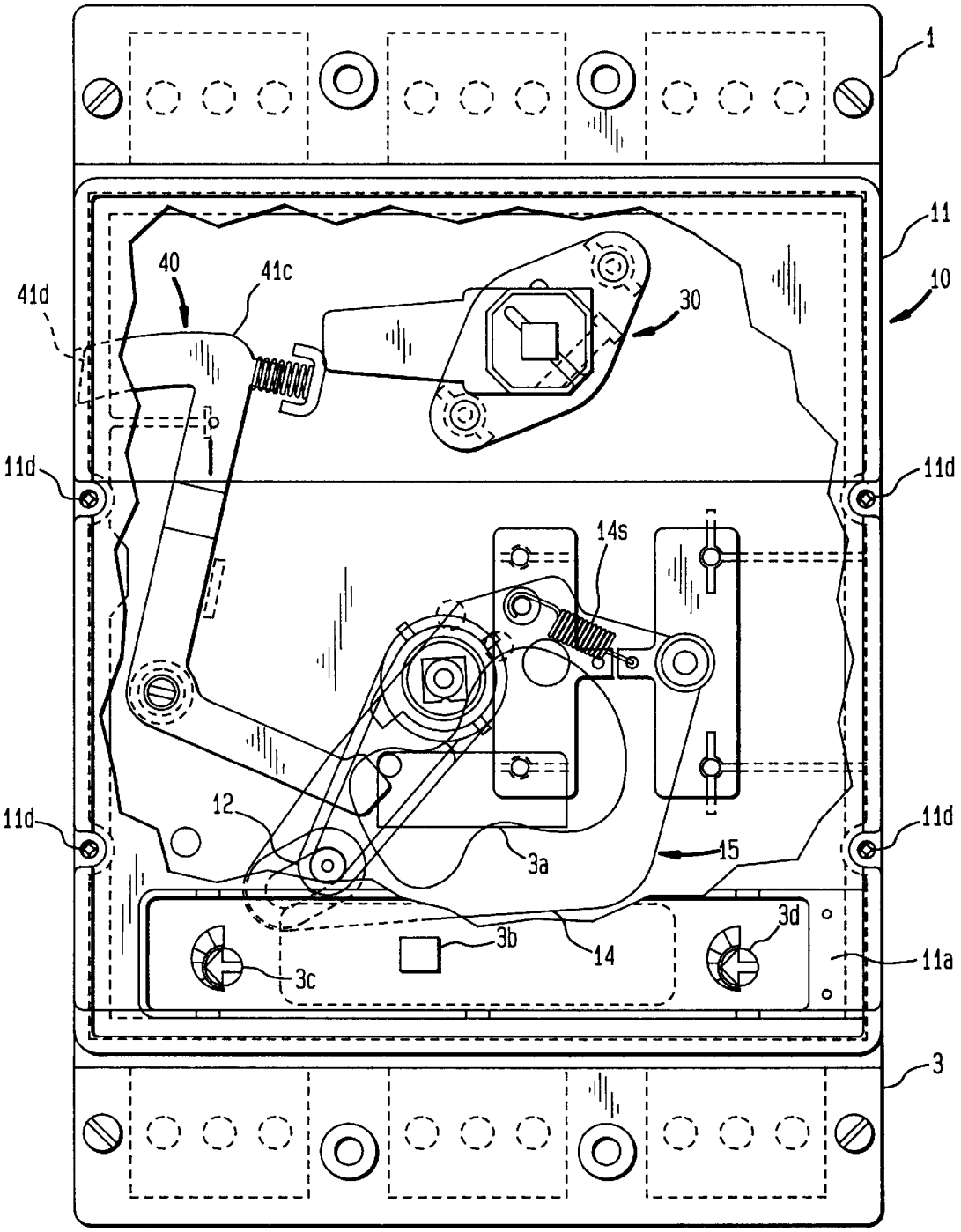

Referring to FIG. 8, the RESET position of the circuit breaker operator handle assembly 1 is shown.

Finally, the circuit breaker operator handle apparatus, means and system described above is also designed to be compatible with certain commercially available enclosure door coupling rotary mechanisms. Specifically, the present system is designed to be compatible with the 8UC6 door coupling rotary mechanism that is available from Siemens AG, a German company.

While the present invention has been described in connection with what are the most practical and preferred embodiments as currently contemplated, it should be understood that the present invention is not limited to the disclosed embodiments. Accordingly, the present invention is intended to cover various modifications and equivalent arrangements, methods and structures that are within the spirit and scope of the claims.

What is claimed is:

1. Circuit breaker operator handle apparatus for use in operating a linearly movable actuator of a circuit breaker assembly, the apparatus comprising:

a housing;

an operator handle pivotally mounted on the housing for pivoting about an operator handle pivot axis;

a cam lever pivotally mounted on the housing for pivoting about a cam lever pivot axis that is parallel to and spaced from the operator handle pivot axis; and a member operatively coupling the operator handle and the cam lever for translating pivoting of the operator handle into pivoting of the cam lever, and vice versa;

the cam lever comprising a thermoplastic body having an aperture adapted to receive a linearly movable actuator of a circuit breaker assembly, and the aperture comprising an edge surface that is shaped to provide a cam profile that directly contacts the actuator for translating pivoting of the cam lever into linear motion of the actuator, and vice versa.

2. Circuit breaker operator handle apparatus as set forth in claim 1 in which the cam profile of the aperture edge surface comprises a first lobe directly contacting the actuator for imparting linear motion to the actuator in a first direction and a second lobe directly contacting the actuator for imparting linear motion to the actuator in a second direction opposite the first direction.

3. Circuit breaker operator handle apparatus as set forth in claim 2 in which the operative connection between the member and the cam lever comprises a slot in one of said member and cam lever and a post on the other of said member and cam lever disposed within the slot.

4. Circuit breaker operator handle apparatus as set forth in claim 3 in which the slot comprises a parallel-sided oval in the thermoplastic body of the cam lever, and the post comprises a cylindrical projection of the member that fits between the parallel sides of the oval.

5. Circuit breaker operator handle apparatus as set forth in claim 1 including a locking lever pivotally mounted on the housing for selective pivoting to a non-interference position with the cam lever and to an interference position with the cam lever to allow pivoting of the cam lever between a first position and a second position when the locking lever is in the non-interference position and to disallow pivoting of the cam lever from the first position to the second position when the locking lever is in the interference position.

6. Circuit breaker operator handle apparatus as set forth in claim 1 including a latching lever pivoted on, and carried by, the operator handle for selective pivoting to a non-interference position with the housing and to an interference position with the housing to allow pivoting of the operator handle about the operator handle pivot axis between a first position and a second position when the latching lever is in non-interference position and to disallow pivoting of the operator handle about the operator handle pivot axis from the first position to the second position when the latching lever is in the interference position.

7. Circuit breaker operator handle apparatus as set forth in claim 1 including an enclosure door interlock adapted to releasably interlock an enclosure door and comprising an interlock lever pivoted on the housing for selective pivoting about an interlock lever pivot axis to a non-interference position with such an enclosure door and to an interference position with such an enclosure door, the interlock lever being pivoted by the crank to the non-interference position when the operator handle is in a first position, and the interlock lever returning to the interference position when the operator handle is in a second position.

8. Circuit breaker operator handle apparatus for use in operating a linearly movable actuator of a circuit breaker assembly, the apparatus comprising:

a housing;

an operator handle pivotally mounted on the housing for pivoting about an operator handle pivot axis;

an actuating mechanism adapted to translate pivoting motion of the operator handle into linear motion of the linearly movable actuator of the circuit breaker, and vice versa; and a latching lever pivoted on, and carried by, the operator handle for selective pivoting to a non-interference position with the housing and to an interference position with the housing to allow pivoting of the operator handle about the operator handle pivot axis between a first position and a second position when the latching lever is in non-interference position and to disallow pivoting of the operator handle about the operator handle pivot axis from the first position to the second position when the latching lever is in the interference position.

9. Circuit breaker operator handle apparatus as set forth in claim 8 in which the housing comprises a hub on which the operator handle is pivoted, and with which the latching lever interferes when in the interference position.

10. Circuit breaker operator handle apparatus as set forth in claim 9 in which the hub comprises a notch within which the latching lever lodges when in the interference position.

11. Circuit breaker operator handle apparatus as set forth in claim 10 in which the operating handle comprises a radial slot that receives the latching lever, the latching lever is pivoted on the operating handle about an axis that is transverse to the radial slot, and the latching lever comprises an aperture that protrudes from the radial slot when the latching lever is in interference position to allow a padlock shackle to be passed through for attaching a padlock to the latching lever.

12. Circuit breaker operator handle apparatus as set forth in claim 11 which the operating handle comprises a depression at an end of the radial slot providing finger tip access to an end of the latching lever, that end of the latching lever comprising a shape that allows a finger tip to pivot the latching lever from non-interference position to interference position.

13. A circuit breaker operator handle system comprising:

a circuit breaker assembly having a linearly movable actuator;

a housing mounted in association with the circuit breaker assembly;

an operator handle pivotally mounted on the housing for pivoting about an operator handle pivot axis;

a cam lever pivotally mounted on the housing for pivoting about a cam lever pivot axis that is parallel to and spaced from the operator handle pivot axis; and a member operatively coupling the operator handle and the cam lever for translating pivoting of the operator handle into pivoting of the cam lever, and vice versa;

the cam lever comprising a thermoplastic body having an aperture adapted to receive a linearly movable actuator of a circuit breaker assembly, and the aperture comprising an edge surface that is shaped to provide a cam profile that directly contacts the actuator for translating pivoting of the cam lever into linear motion of the actuator, and vice versa.

14. A circuit breaker operator handle system as set forth in claim 13 in which the cam profile of the aperture edge surface comprises a first lobe directly contacting the actuator for imparting linear motion to the actuator in a first direction and a second lobe directly contacting the actuator for imparting linear motion to the actuator in a second direction opposite the first direction.

15. A circuit breaker operator handle system as set forth in claim 14 in which the operative connection between the member and the cam lever comprises a slot in one of said member and cam lever and a post on the other of said member and cam lever disposed within the slot.

16. A circuit breaker operator handle system as set forth in claim 18 in which the slot comprises a parallel-sided oval in the thermoplastic body of the cam lever, and the post comprises a cylindrical projection of the member that fits between the parallel sides of the oval.

17. A circuit breaker operator handle system as set forth in claim 13 including a locking lever pivotally mounted on the housing for selective pivoting to a non-interference position with the cam lever and to an interference position with the cam lever to allow pivoting of the cam lever between a first position and a second position when the locking lever is in the non-interference position and to disallow pivoting of the cam lever from the first position to the second position when the locking lever is in the interference position.

18. A circuit breaker operator handle system as set forth in claim 17 in which the locking lever comprises an end surface that is generally perpendicular to a radial to the axis about which the locking lever pivots, and that end surface is placed in face-to-face confrontation to a surface of the cam lever when the locking lever is operated to locked position, such face-to-face confrontation blocking pivoting of the cam lever in a direction toward the locking lever.

19. A circuit breaker operator handle system as set forth in claim 13 including a latching lever pivoted on, and carried by, the operator handle for selective pivoting to a non-interference position with the housing and to an interference position with the housing to allow pivoting of the operator handle about the operator handle pivot axis between a first position and a second position when the latching lever is in non-interference position and to disallow pivoting of the operator handle about the operator handle pivot axis from the first position to the second position when the latching lever is in the interference position.

20. A circuit breaker operator handle system as set forth in claim 13 including an enclosure door interlock adapted to releasably interlock an enclosure door and comprising an interlock lever pivoted on the housing for selective pivoting about an interlock lever pivot axis to a non-interference position with such an enclosure door and to an interference position with such an enclosure door, the interlock lever being pivoted by the crank to the non-interference position when the operator handle is in a first position, and the interlock lever returning to the interference position when the operator handle is in a second position.

21. A circuit breaker operator handle system as set forth in claim 13 including a spring which biases the cam lever to maintain the cam profile in direct contact with the circuit breaker assembly actuator.

22. A circuit breaker operator handle system comprising:

a circuit breaker assembly having a linearly movable actuator;

a housing mounted in association with the circuit breaker assembly;

an operator handle pivotally mounted on the housing for pivoting about an operator handle pivot axis;

an actuating mechanism adapted to translate pivoting motion of the operator handle into linear motion of the linearly movable actuator of the circuit breaker, and vice versa; and a latching lever pivoted on, and carried by, the operator handle for selective pivoting to a non-interference position with the housing and to an interference position with the housing to allow pivoting of the operator handle about the operator handle pivot axis between a first position and a second position when the latching lever is in non-interference position and to disallow pivoting of the operator handle about the operator handle pivot axis from the first position to the second position when the latching lever is in the interference position.

23. A circuit breaker operator handle system as set forth in claim 22 in which the housing comprises a boss about which the operator handle pivots, and with which the latching lever latches when in the interference position.

24. A circuit breaker operator handle system as set forth in claim 23 in which the boss comprises a notch within which the latching lever lodges when in the interference position.

25. A circuit breaker operator handle system as set forth in claim 22 in which the operating handle comprises a radial slot that receives the latching lever, the latching lever is pivoted on the operating handle about an axis that is transverse to the radial slot, and the latching lever comprises an aperture that protrudes from the radial slot when the latching lever is in interference position to allow a padlock shackle to be passed through for attaching a padlock to the latching lever.

26. A circuit breaker operator handle system as set forth in claim 25 in which the operating handle comprises a depression at an end of the radial slot providing finger tip access to an end of the latching lever, that end of the latching lever comprising a shape that allows a finger tip to pivot the latching lever from non-interference position to interference position.

27. Circuit breaker operator handle apparatus for use in operating a linearly movable actuator of a circuit breaker assembly, the apparatus comprising:

a housing comprising a face that contains a through-hole and that frontally bounds an interior of the housing;

a boss disposed on the face exterior of the housing and circumscribing the through-hole;

an operator handle disposed exterior of the housing and pivotally mounted on the housing face for pivoting about an operator handle pivot axis, the operator handle having a socket fitting onto and over the boss to make the pivot axis coincident with the through-hole and boss;

a cam lever disposed within the interior of the housing and pivotally mounted on the housing for pivoting about a cam lever pivot axis that is parallel to and spaced from the operator handle pivot axis; and a driver operatively disposed within the interior of the housing and coupling the operator handle and the cam lever for translating pivoting of the operator handle into pivoting of the cam lever, and vice versa, the driver comprising a pivot post received in the through-hole and boss to pivotally mount the driver on the housing face; and a fastener fastening the operator handle to the driver pivot post so that the handle and driver turn together about the pivot axis.

28. Circuit breaker operator handle apparatus as set forth in claim 27 in which the driver includes a post for operating an enclosure door interlock assembly.

29. Circuit breaker operator handle apparatus as set forth in claim 28 in which the operating handle carries a latch for selectively latching the operating handle to the boss to selectively allow and disallow turning of the handle.

* * * * *